US005134255A

United States Patent [19]

Tetrault et al.

[11] Patent Number: 5,134,255

[45] Date of Patent: Jul. 28, 1992

[54] MINIATURE ACCELERATION SWITCH

[75] Inventors: Leonard P. Tetrault, Northport; Corey C. Jordan, Lake Grove, both of N.Y.

[73] Assignee: Aerodyne Controls Corporation, Ronkokoma, N.Y.

[21] Appl. No.: 670,567

[22] Filed: Mar. 18, 1991

[51] Int. Cl.[5] ..... H01H 35/14

[52] U.S. Cl. ..... 200/61.45 R; 200/61.53

[58] Field of Search ..... 200/61.45 R, 61.45 M, 200/61.5, 61.52, 61.53

[56] References Cited

U.S. PATENT DOCUMENTS

| | | | |
|---|---|---|---|
| 3,300,603 | 1/1967 | Wakely | 200/61.45 R |
| 3,657,500 | 4/1972 | Gawlick et al. | 200/61.45 R |
| 4,746,774 | 5/1988 | Tetrault et al. | 200/61.45 R |
| 4,789,762 | 12/1988 | Miller et al. | 200/61.45 R |
| 4,916,266 | 4/1990 | Tetrault | 200/61.45 R |

*Primary Examiner*—J. R. Scott

*Attorney, Agent, or Firm*—Edward H. Loveman

[57] ABSTRACT

This miniature normally open circuited acceleration switch has a hollow cylindrical casing closed at one end. Its other end is closed by a header having an insulated axial lead wire extending inwardly of the casing, and an electrically conductive ring secured peripherally to the casing. Inside the casing is an internally conical guide sleeve in which is a freely rollable massive ball. A lightweight cup-shaped piston in the guide sleeve carries a contact member spaced by an expanded coil spring from the lead wire. The ball impinges on the piston when a sufficient axially directed force of acceleration is applied to the casing, even if a simultaneous laterally directed force of acceleration is applied thereto. The piston moves axially against the spring bias such that the contact member contacts the lead wire to close the normally open circuited switch.

12 Claims, 2 Drawing Sheets

MINIATURE ACCELERATION SWITCH

BACKGROUND OF THE INVENTION

1. Field of the Invention

This invention relates to the art of electrical acceleration switches of the type having a mass movable in a housing against a spring bias in response to an applied acceleration and more particularly concerns a miniature acceleration switch responsive to a relatively small axial acceleration to close normally open contacts in the switch, in the presence of large laterally directed accelerations on the switch.

2. Description of the Prior Art

Prior acceleration switches such as described in U.S. Pat. No. 4,916,266 and 4,746,774 employ movable masses spring biased to open or closed contact positions. When sufficient axial or lateral forces are applied and the spring bias is overcome, the switches open or close as desired. These prior acceleration switches are not suitable for use in applications such as sensing crashes of aircraft. In the prior switches, sensitivity is lost because the bias in the spring bears constantly on the movable mass and must be overcome before the switch operates In those switches having generally cylindrical movable masses. high laterally directed accelerations increase the friction resistance to axial movement so that response to relatively light axial accelerations is inhibited.

SUMMARY OF THE INVENTION

The principal object of the present invention is to provide a highly sensitive acceleration switch which will respond to relatively light axially directed accelerations independently of high laterally directed accelerations, and will close normally open switch contacts with little or no contact bounce.

A further object of the present invention is to provide a highly sensitive acceleration switch in which frictional resistance to movement of the total active mass in the switch is minimized by the spherical shape of a movable mass and the light weight of a cylindrical moveable mass retaining one of the switch contacts.

According to the invention there is provided an acceleration switch which can respond to an axially directed acceleration as small as 2 g (where g is a standard unit of acceleration equal to that due to earth's gravity), even in the presence of laterally directed accelerations as high as 30 g. A small, massive spherical member, such as a metal ball is movable in a conical guide sleeve inside a cylindrical casing. The switch has normally open switch contacts which are closed by a lightweight movable piston when the ball impinges on the piston, against the bias of a coil spring. The piston need not be electrically conductive. The mass of the ball may be seven or more times that of the movable cup-shaped piston. A further feature of the invention is the conical shape of the guide sleeve which is effective to cause generation of a force vector axially of the switch housing when a laterally directed force is applied, to assist any axial force in moving the spherical mass to close the switch contacts.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENT

Figure 1:
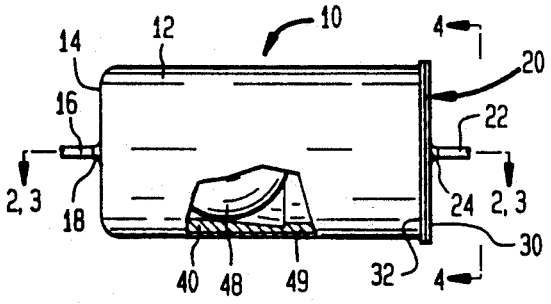
FIG. 1 is a side elevational view of an acceleration switch embodying the invention, part being broken away to show internal construction.
Figure 4:
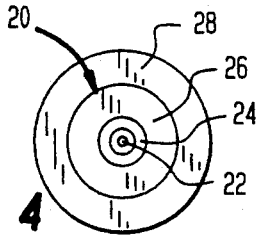
FIG. 4 is an end elevational view taken along line 4–4 of FIG. 1.

Referring now to the drawings wherein like reference characters designate like or corresponding parts throughout, there is illustrated in FIGS. 1 through 4 and 6 an acceleration switch designated generally by numeral 10. The switch 10 has a cylindrical, electrically conductive metal casing 12 closed by an end wall 14 to which a lead wire 16 is secured by a weld 18. The other open end of the casing is closed by a header assembly 20. The header assembly 20 comprises a lead wire 22 extending axially through and secured in a disk shaped insulator 24 made of glass, ceramic or the like. The insulator 24 is secured in an electrically conductive metal ring 26 which is peripherally welded to an outer electrically conductive metal ring 28. An annular flange 30 formed on the ring 28 is welded to an annular flange 32 formed at the end of the casing 12, to form a hermetically sealed joint.

Inside the hermetically closed and sealed casing 12 is a spacer disk 34 abutted to the end wall 14. The spacer disk 34 has a peripheral flange 36 against which is abutted a thicker end 38 of a guide sleeve 40. An outer wall 42 of the sleeve 40 is cylindrical and fits closely inside the cylindrical wall of the casing 12. An inner wall 44 of the guide sleeve 40 has a tapered section 46 on which is normally disposed a massive spherical member 48. The spherical member 48 may be a solid brass ball preferably having a diameter slightly smaller than the inside of the sleeve 40 so that the ball 48 is free to move axially of the casing 12 from the left end position shown in FIG. 2 to the right end position shown in FIG. 3.

Figure 5:
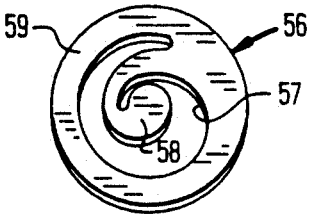
FIG. 5 is an enlarged, oblique view of a spring contact member employed in the switch.
Figure 7:
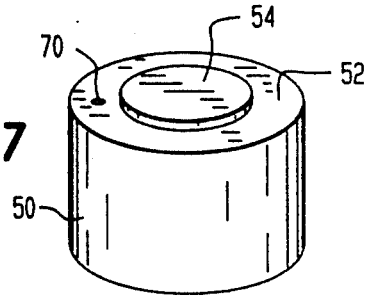
FIG. 7 is a perspective view of a movable, lightweight piston employed in the switch, shown inverted from its position in FIG. 6.
Figure 6:
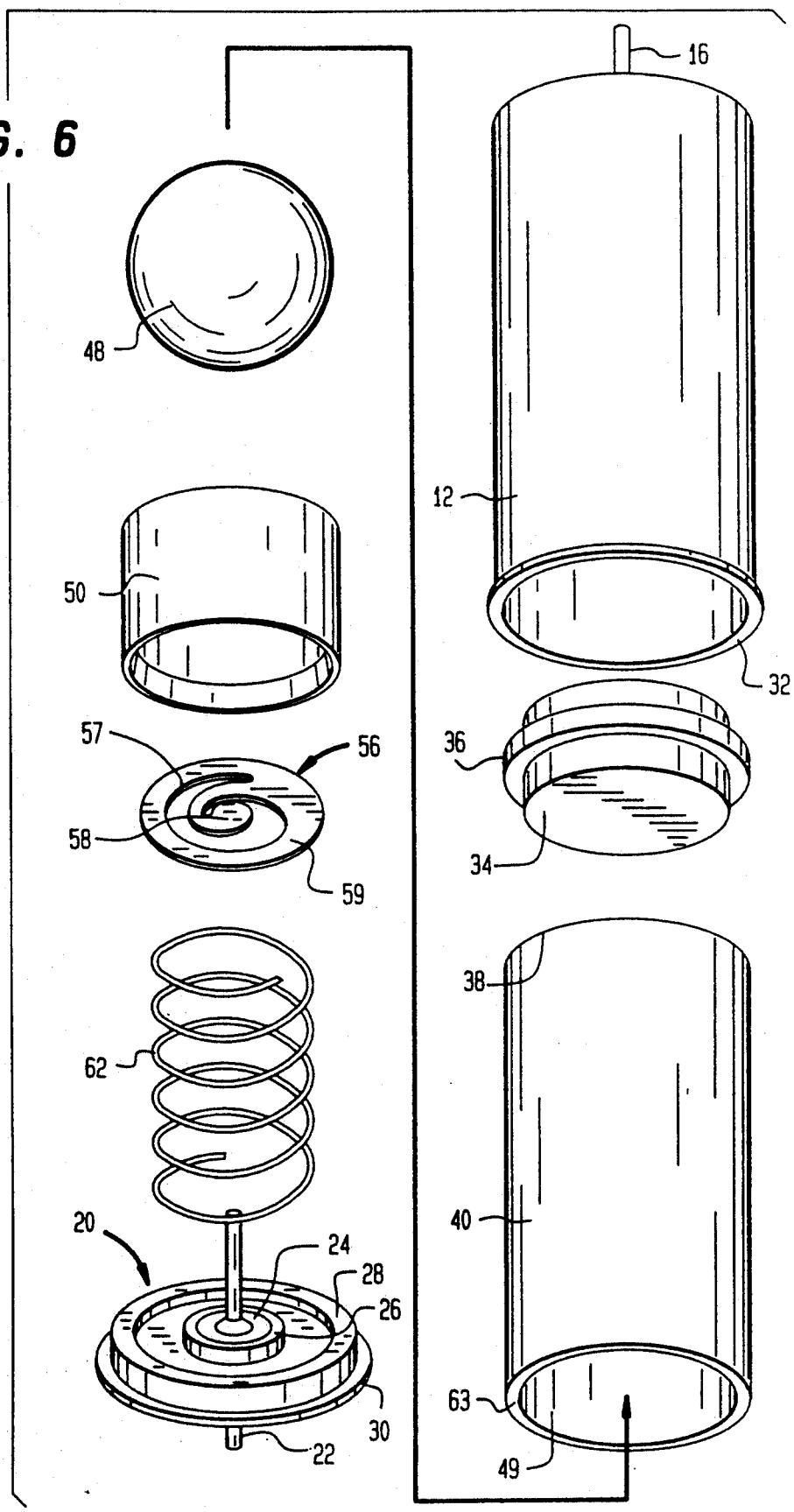
FIG. 6 is an exploded perspective view of parts on the acceleration switch according to the invention.

The guide sleeve 40 has a cylindrical end section 49 in which is a cup-shaped piston 50 which is axially slidable and is made of lightweight material such as aluminum, plastic, etc. to insure a minimal friction force with lateral acceleration. A closed end wall 52 of the piston 50 faces and normally contacts the ball 48. A center button 54 may be provided on the left side of the wall 52. The diameter of a hole 70, which passes through the wall 52, is tailored to control the amount of dampening necessary for the moving masses to ignore high frequency inputs, such as aircraft vibration or doors slamming, and still respond to longer duration motion inputs i.e. aircraft crash. Inside the piston 50 is a flat circular electrically conductive spring contact 56 which, as best shown in FIGS. 5 and 6, has a spiral cutout 57 to increase its flexibility. The contact 56 has a center portion 58 normally spaced from the inner end of the lead wire 22. The peripheral, circular portion 59 of the contact member 56 fits snugly inside the piston 50 against the end wall 52. The cylindrical piston 50 slides axially inside the sleeve 40. A coil spring 62 is anchored on the inside of the ring 28 and extends axially up to the contact spring 56. By dimensioning the thickness of the spacer disk 34, the bias of the spring 62 may be controlled, and in the case where the diameter of the guide sleeve inner wall 44 is smaller than the diameter of the ball 48, the spacer disk 34 prevents the ball 48 from being wedged in the guide sleeve inner wall 44. The right end 63 of the guide sleeve 40 abuts the inner side of the ring 28.

Figure 3:
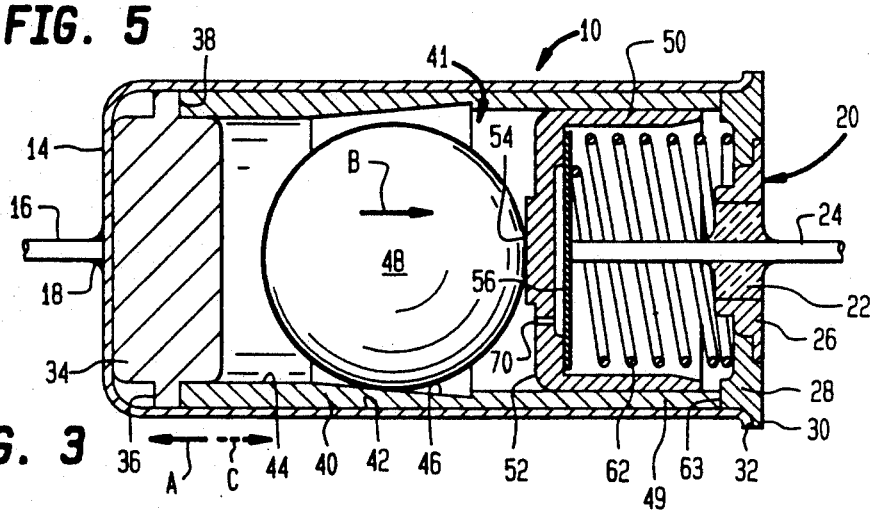
FIG. 3 is a sectional view similar to FIG. 2, the switch contacts being shown in closed position.
Figure 2:
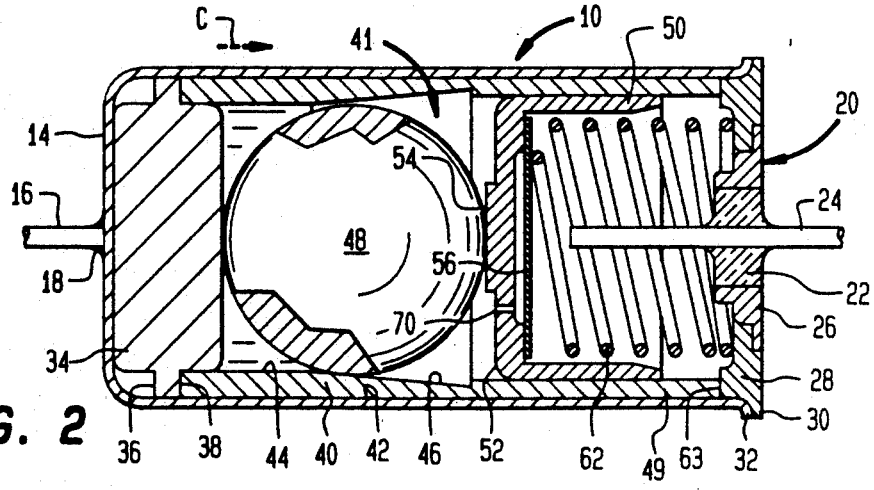
FIG. 2 is an enlarged axial sectional view taken along line 2—2 of FIG. 1, the switch contacts being shown in open position.

When the switch 10 is in closed position as shown in FIG. 3, there is a continuous direct electric circuit from the lead wire 22 to the center 58 of the contact 56; then via the electrically conductive coil spring 62 to the metal ring 28; then via the electrically conductive sleeve 40 and the casing 12 to the lead wire 16. Normally, the ball 48 is located on the sleeve surface 40, pressed between the spacer disk 34 and the piston center button 54 as shown in FIG. 2. The inner end of the lead wire 22 is spaced from the center portion 58 of the contact 56 due to the expanded condition of the coil spring 62 which maintains the switch 10 in open circuit position.

In operation of the switch 10, it is normally disposed in axially horizontal position as shown in FIGS. 1-3. If a condition of axial acceleration exceeding for example 2 g's occurs, in the direction of arrow A shown in FIG. 3, the ball 48 will move the piston 50 axially against the bias in the spring 62 until the contact spring 56 touches the inner end of the lead wire 22, which closes the switching circuit. The switch 10 will operate in the same manner as described if it is desired to respond to a force of deceleration. In such an application the switch 10 will be moved axially horizontally in the direction C opposite to direction A, as indicated in FIGS. 2 and 3. Upon deceleration, a force equal to the deceleration times the weight of the moving masses is directed axially, which when greater than the spring bias, will cause the ball 48 to move to the right in the direction B to close the switch contacts as shown in FIG. 3. The switch 10, in the preferred embodiment, will also respond to an axial deceleration force vector of at least 2 g coincident with application of a laterally directed acceleration of at least 30 g.

An important feature of the invention is the conical shape of the inside of the sleeve 40 at tapered section 46. This defines a conical passage 41 which flares from minimum to maximum diameter from left to right as viewed in FIGS. 2 and 3, and permits the ball 48 to move freely to the right.

In a preferred embodiment of the invention the following approximate dimensions of the miniature switch may be employed:

Axial length of casing 12, about ⅔ inches or 0.66".

Diameter of casing 12, about ⅓ inches or 0.33".

Diameter of ball 48, about ¼ inches or 0.25".

Length of travel of ball 48, about 1/16 inches or 0.0625".

Diameter of contact 56 and spring 62, about 1/5 inches or 0.20".

The mode of assembly of the switch 10 can be best understood by reference FIGS. 2, 3 and 6. The spacer 34 is first inserted into the open end of the cylindrical shell or casing 12. Then the sleeve 40 is inserted axially into the casing 12. Thereafter the ball 48, the piston 50, the contact 56 and the spring 62 are inserted in turn. The assembled header 20 is then secured by welding the peripheral flange 30 to the flange 32 of the casing 12.

The relatively simple construction of the switch, minimizes the possibility of the switch not functioning properly. The switch construction insures that the switch will have a long shelf-life and that it will always operate positively when called upon to do so in an emergency such as an airplane crash.

It should be understood that the foregoing relates only to a limited number of preferred embodiments of the invention which have been by way of and that it is intended to cover all changes and modifications of the examples of the invention herein chosen for the purpose of the disclosure, which do not constitute departures from the spirit and scope of the invention.

What is claimed is:

1. A miniature acceleration switch, comprising:

a hollow, cylindrical, electrically conductive casing closed at one end and open at its other end to define a cylindrical chamber therein;

a massive spherical member rollable axially in said chamber;

a header closing said other end of said casing, said header having a lead wire extending axially through an insulator into said casing;

an electrically conductive ring surrounding said lead wire and secured to said other end of said casing;

a lightweight piston movable axially in said casing;

an electrically conductive contact member carried by said piston; and a coil spring extending axially in said casing, one ned of said spring contacting said ring, and another end of said spring contacting said contact member, so that said coil spring in normally expanded position holds said contact member, spaced from said lead wire;

whereby a force of acceleration directed axially of said casing causes said spherical member to move said piston and said contact member into contact with said lead wire.

2. A miniature acceleration switch as claimed in claim 1, further comprising an electrically conductive guide sleeve inside said casing extending axially between said ring and said closed end of said casing, when said spherical member moves said piston and said contact member into contact with said lead wire.

3. A miniature acceleration switch as claimed in claim 2, wherein said guide sleeve has an internal wall defining a conical passage in which is said spherical member to facilitate rolling of said spherical member axially in said casing when displaced by said force of acceleration directed axially of said casing.

4. A miniature acceleration switch as claimed in claim 3, wherein said contact member has a circular portion normally contacted by said other end of said spring, and a center portion disposed for contact by said lead wire, said contact member having a cutout to facilitate slight flexing of said contact member to insure positive contact between said contact member and said lead wire.

5. A miniature acceleration switch as claimed in claim 1, wherein said piston is cup shaped and has a mass which is substantially less than that of said spherical member to insure that the friction force is minimized with lateral acceleration.

6. A miniature acceleration switch as claimed in claim 1, wherein said piston has dampening means for resisting motion of said spherical member.

7. A miniature acceleration switch as claimed in claim 1, wherein said piston is made of electrically, nonconductive material.

8. A miniature acceleration switch as claimed in claim 6, further comprising another lead wire attached to said closed end of said casing.

9. A miniature acceleration switch as claimed in claim 2, further comprising a spacer member at said closed end of said casing abutting one end of said guide sleeve to hold the same in place in said casing.

10. A miniature acceleration switch as claimed in claim 1, wherein said spherical member has such a large mass and is so freely rollable that it will be displaced axially of said casing by a small force of acceleration directed axially of said casing, while simultaneously experiencing an axially directed force vector produced by a laterally directed force of acceleration fifteen times or more greater than the axially directed acceleration force to cause said contact member to contact said lead wire.

11. A miniature acceleration switch as claimed in claim 10, further comprising a guide sleeve inside said casing and having an internal flared conical portion normally surrounding said spherical member to facilitate rolling of said spherical member axially of said casing when a force of acceleration of at least 2 g is directed axially of said casing, and when simultaneously a force of at least 30 g is directed laterally of said casing to generate said axial force vector.

12. A miniature acceleration switch as claimed in claim 1, wherein said header is welded to said other end of said casing to form a hermetically sealed switch.

* * * * *